US010233746B2

(12) United States Patent
Johnson et al.

(10) Patent No.: US 10,233,746 B2
(45) Date of Patent: Mar. 19, 2019

(54) WELLBORE COMPLETION FOR METHANE HYDRATE PRODUCTION WITH REAL TIME FEEDBACK OF BOREHOLE INTEGRITY USING FIBER OPTIC CABLE

(71) Applicant: BAKER HUGHES, A GE COMPANY, LLC, Houston, TX (US)

(72) Inventors: Michael H. Johnson, Katy, TX (US); Bennett M. Richard, Kingwood, TX (US); John K. Wakefield, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 172 days.

(21) Appl. No.: 14/448,636

(22) Filed: Jul. 31, 2014

(65) Prior Publication Data

US 2015/0068739 A1 Mar. 12, 2015

Related U.S. Application Data

(63) Continuation-in-part of application No. 14/023,982, filed on Sep. 11, 2013, now Pat. No. 9,097,108.

(51) Int. Cl.

| | |
|---|---|
| ***E21B 17/18*** | (2006.01) |
| ***E21B 47/08*** | (2012.01) |
| ***E21B 43/10*** | (2006.01) |
| *E21B 43/01* | (2006.01) |

(52) U.S. Cl.

CPC ..... *E21B 47/08* (2013.01); *E21B 43/108* (2013.01); *E21B 2043/0115* (2013.01)

(58) Field of Classification Search

CPC ..... E21B 17/18; E21B 17/206; E21B 43/006; E21B 43/255

USPC ..... 166/276

See application file for complete search history.

(56) References Cited

U.S. PATENT DOCUMENTS

| | | | |
|---|---|---|---|
| 6,148,911 | A | 11/2000 | Gipson et al. |
| 7,413,022 | B2 | 8/2008 | Broome et al. |
| 7,578,343 | B2 | 8/2009 | Augustine |
| 7,743,835 | B2 | 6/2010 | Willauer |
| 7,832,490 | B2 | 11/2010 | Willauer |
| 7,921,915 | B2 | 4/2011 | Richard et al. |
| 7,926,565 | B2 | 4/2011 | Duan et al. |
| 7,954,546 | B2 | 6/2011 | Kim et al. |
| 8,048,348 | B2 | 11/2011 | Duan et al. |

(Continued)

FOREIGN PATENT DOCUMENTS

| | | | |
|---|---|---|---|
| WO | 2008151311 | A2 | 12/2008 |
| WO | 2010045077 | A2 | 4/2010 |

(Continued)

*Primary Examiner* — William D Hutton, Jr.
*Assistant Examiner* — Ashish K Varma
(74) *Attorney, Agent, or Firm* — Shawn Hunter

(57) ABSTRACT

In producing methane a bottom hole assembly the borehole may enlarge due to shifting sands in an unconsolidated formation as the methane is produced. The enlargement of the borehole can be sensed in real time such as by using a fiber optic cable. In response to such information parts of the bottom hole assembly near the washout can be isolated or the bottom hole assembly in the vicinity of the washout can be fortified with inserts from the surface to minimize damage from erosion caused by higher velocities resulting from borehole washouts.

18 Claims, 3 Drawing Sheets

(56) References Cited

U.S. PATENT DOCUMENTS 8,225,863 B2 * 7/2012 Hammer ..... E21B 34/14 166/235
8,353,346 B2 1/2013 Johnson
2003/0075333 A1 4/2003 Vercaemer et al.
2004/0104052 A1 * 6/2004 Livingstone ..... E21B 7/04 175/61
2004/0177961 A1 9/2004 Nguyen
2004/0261994 A1 12/2004 Nguyen et al.
2007/0144741 A1 * 6/2007 Cho ..... E21B 23/02 166/255.2
2008/0296020 A1 12/2008 Willauer
2008/0296023 A1 * 12/2008 Willauer ..... C08K 3/08 166/302
2009/0032244 A1 2/2009 Zupanick
2009/0101353 A1 4/2009 Crow et al.
2009/0178805 A1 7/2009 Yemington
2010/0077594 A1 4/2010 Richard
2010/0089565 A1 * 4/2010 Duan ..... E21B 43/082 166/51
2010/0294513 A1 11/2010 Van Nieuwkoop
2011/0067872 A1 3/2011 Agrawal
2011/0073296 A1 3/2011 Richard et al.
2011/0162780 A1 7/2011 Duan et al.
2011/0232901 A1 9/2011 Carrejo et al.
2011/0252781 A1 10/2011 Johnson
2011/0259587 A1 10/2011 Joseph et al.
2012/0000648 A1 1/2012 Mathew et al.
2012/0145389 A1 6/2012 Fitzpatrick, Jr.
2012/0181017 A1 7/2012 Hart et al.
2012/0247761 A1 10/2012 O'Malley
2013/0062067 A1 3/2013 Guest et al.
2013/0090854 A1 4/2013 Rasmus et al.
2013/0126170 A1 5/2013 Johnson et al.
2013/0206406 A1 8/2013 Kuo et al.
2013/0248179 A1 * 9/2013 Yeh ..... E21B 23/06 166/278
2013/0277068 A1 10/2013 Richard

FOREIGN PATENT DOCUMENTS

WO 2011037950 A2 3/2011
WO 2011133319 A2 10/2011
WO 2011162895 A2 12/2011

* cited by examiner

WELLBORE COMPLETION FOR METHANE HYDRATE PRODUCTION WITH REAL TIME FEEDBACK OF BOREHOLE INTEGRITY USING FIBER OPTIC CABLE

CROSS REFERENCE TO RELATED APPLICATION

This application is a continuation-in-part of U.S. patent application Ser. No. 14/023,982, for "Wellbore Completion for Methane Hydrate Production", filed on Sep. 11, 2013, and claims the benefit of priority from the aforementioned application.

FIELD OF THE INVENTION

The field of this invention is completions and more particularly in unconsolidated formations that produce methane hydrate where there is a need for sand control and flow distribution to protect the screen while stabilizing the borehole.

BACKGROUND OF THE INVENTION

Methane hydrate exists as a solid substance in layers that contain sand and other sediment. Hydrate to methane gas and water must be accomplished in order to produce the methane gas. The production of methane hydrate means dissociating methane hydrate in the layers and collecting the resultant methane gas through wells and production systems. To dissociate methane hydrate that is stable at low temperature and under high pressure, there must be an (1) increase in the temperature, (2) decrease in pressure, (3) or both. The optimum methane hydrate production method is one based on the "depressurization method." However, since methane hydrate layers are unconsolidated sediments, sand production occurs with the methane gas and water. Because removal of the methane, water, and sand, wellbore stability becomes an issue that cannot be overcome with conventional sand control methodologies. Economical and effective measures for preventing sand production and solving borehole stability issues require a novel approach to completion methodology.

One proposed method to control sand production and provide better borehole stability comprises providing a shape memory polymer foam filter that does not depend on the borehole for containment for sand management. The shape memory polymer will be utilized such that a flow path would not be directly exposed to the screen that would permit the production of sand from the borehole. One other issue related to the depressurization method of methane hydrate production is the uniform application of a differential pressure across the reservoir interface. The method further comprises a porous media under the shaped memory polymer foam filter that can be varied in number and permeability to balance the differential pressure applied to the reservoir being produced. This improves borehole stability via uniform drawdown and flow from the exposed reservoir. While these techniques could be used in a conventional open hole or cased hole completion, it is desirable to under ream or expand the borehole size to help increase wellbore radius and decrease flow velocities at the sand management/reservoir interface. Another aspect is that fiber optic or some other real time way of sensing the location and extent of hole collapse during production can be employed to close off portions of a producing zone or otherwise fortify a portion of the bottom hole assembly against higher velocities that could otherwise erode filtration components to the point of producing sand or other impurities with the methane.

Several references that employ memory foam in sand control applications are as follows:

WO/2011/162895A;
U.S. Pat. No. 8,353,346
US20110252781
WO/2011/133319A2
US20130062067
WO/2013/036446A1
US2013016170
U.S. Pat. No. 8,048,348
US20100089565
US20110162780
U.S. Pat. No. 796,565
WO/2010/045077A2
US20110067872
WO/2011/037950A2
U.S. Pat. No. 7,832,490
US20080296023
US20080296020
U.S. Pat. No. 7,743,835
WO/2008/151311A3

Flow balancing devices are generally discussed in the following references:

U.S. Pat. No. 7,954,546
U.S. Pat. No. 7,578,343
U.S. Pat. No. 8,225,863
U.S. Pat. No. 7,413,022
U.S. Pat. No. 7,921,915

A need exists for an assembly and method of producing methane from an unconsolidated formation surrounding a borehole having methane hydrate, sand or other sediments. Once positioned and set near the formation, the filtration assembly should be able to manage sand and other sediments without having to rely on the geometric configuration of the borehole for containment, such that should the surrounding borehole subsequently enlarge or the space between the formation and the assembly increase due to changing reservoir conditions the geometric configuration of the assembly will not substantially change.

Those skilled in the art will better appreciate additional aspects of the invention from a review of the detailed description of the preferred embodiment and the associated drawings while appreciating that the full scope of the invention is to be determined by the appended claims.

SUMMARY OF THE INVENTION

In a completion for producing methane the bottom hole assembly has a base pipe with porous media within it for equalizing flow along the base pipe. A shape memory polymer foam surrounds the base pipe with porous media. The borehole can be reamed to reduce produced methane velocities. The borehole may enlarge due to shifting sands in an unconsolidated formation as the methane is produced. The bottom hole assembly helps in fluid flow equalization and protects the foam and layers below from high fluid velocities during production. The enlargement of the borehole can be sensed in real time such as by using a fiber optic cable. In response to such information parts of the bottom hole assembly near the washout can be isolated or the bottom hole assembly in the vicinity of the washout can be fortified with inserts from the surface to minimize damage from erosion caused by higher velocities resulting from borehole washouts.

DETAILED DESCRIPTION OF THE PREFERRED EMBODIMENT

In broad terms the preferred embodiment can be described as a filtration assembly and method of producing methane from methane hydrate in an unconsolidated formation containing sand and other sediments. The filtration assembly comprises a bottom hole assembly comprising a sand control assembly and a base pipe. The sand control assembly comprises a shape memory porous material, which is adapted to surround the base pipe and form a first discrete filtration layer. In one embodiment, a second discrete filtration layer is located under the first discrete filtration layer and comprises one or more filtration assurance devices adapted to support the first discrete filtration layer, assist in filtering sediment from the methane, or aid in depressurization of the formation, or any combination thereof, such as wire mesh, beadpack or both.

In a preferred embodiment, the shape memory porous material is an open-cell shape memory foam, such as the foam described in the list of memory foam patents and patent applications referenced above, and the memory foam marketed by Baker Hughes Incorporated under the trademark GEOFORM™. The memory foam is adapted to help manage sand production by inhibiting the formation of a flow path through the filtration layer in which sand may be produced and by providing borehole stability without having to depend on containment by the surrounding borehole.

To dissociate methane from methane hydrate, a depressurization method is employed by applying a differential pressure across the reservoir interface between the bottom hole assembly and the formation, using, for example, an electric submersible pump. As the methane dissociates from methane hydrate it passes through the filtration assembly, which filters sand and other sediments from the methane and allows the methane to enter the base pipe. In one embodiment, the base pipe comprises a depressurization device designed to help equalize flow along at least one interval of the base pipe and protect the filtration layers from high fluid velocities during production. As previously mentioned, however, the second discrete filtration layer when located under the first discrete filtration layer may also serve as a means of assisting in the depressurization of the formation. The borehole may also be reamed to reduce methane production velocities.

Should the borehole subsequently enlarge or the space between the formation and the bottom hole assembly increase due to changing reservoir conditions (e.g., shifting of sands or other sediments in an unconsolidated formation as the methane is produced) the geometric configuration of the bottom hole assembly will not substantially change.

Figure 1:
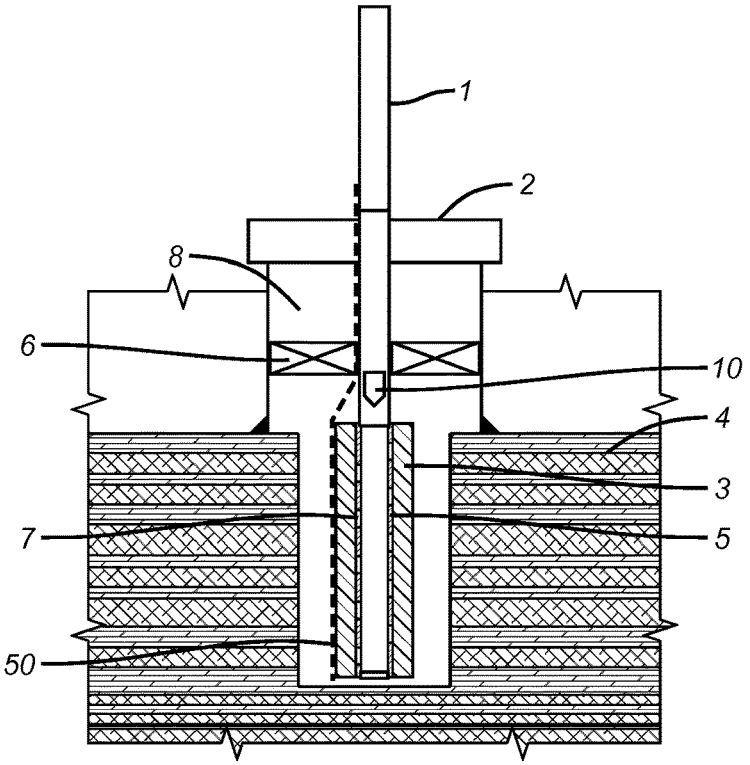
FIG. 1 shows the run in position of the bottom hole assembly with the shape memory polymer foam as yet unexpanded.

Referring to FIG. 1 a work string 1 is run through a wellhead 2. The bottom hole assembly comprises a base pipe 5 with openings. A production packer 6 isolates the methane hydrate reservoir 4. In one embodiment, the base pipe 5 has flow balancing devices 7, such as an annularly shaped porous member of different thicknesses and porosities, or a housing having one or more tortuous paths of different resistances to fluid flow, adapted to help equalize flow along at least one interval of the base pipe and help protect the filtration layers from high fluid velocities during production such as a choke valve, bead pack, wired mesh 50.

In one embodiment, the base pipe comprises a depressurization device for balancing flow along at least one interval of the base pipe, or a selectively or automatically adjustable inflow control member (e.g., an adjustable valve or tubular housing having one or more inflow passages, preferably with a tortuous pathway). See for example, U.S. Pat. Pub. No. 2013/0180724 and flow control products marketed by Baker Hughes Incorporated (United States of America) under the trademark EQUALIZER™.

Figure 2:
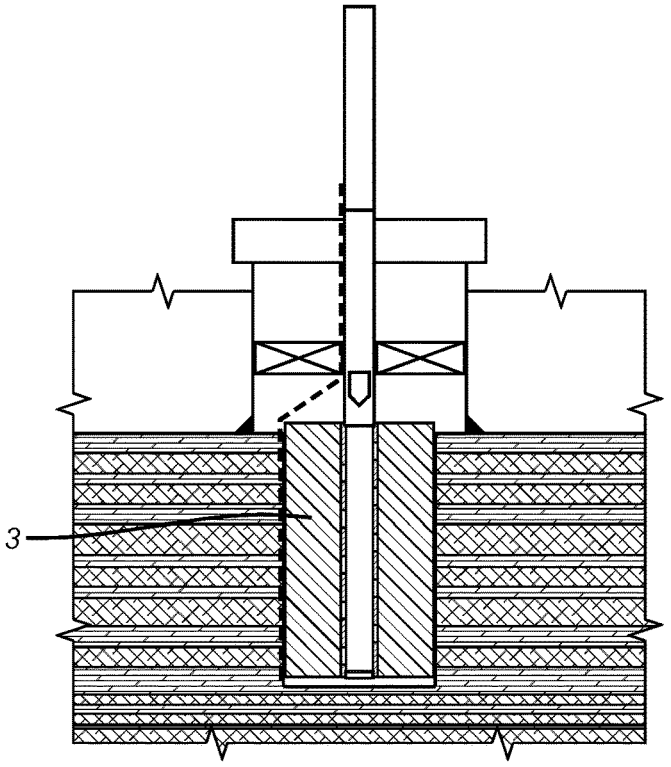
FIG. 2 is the view of FIG. 1 with the polymer foam expanded.
Figure 3:
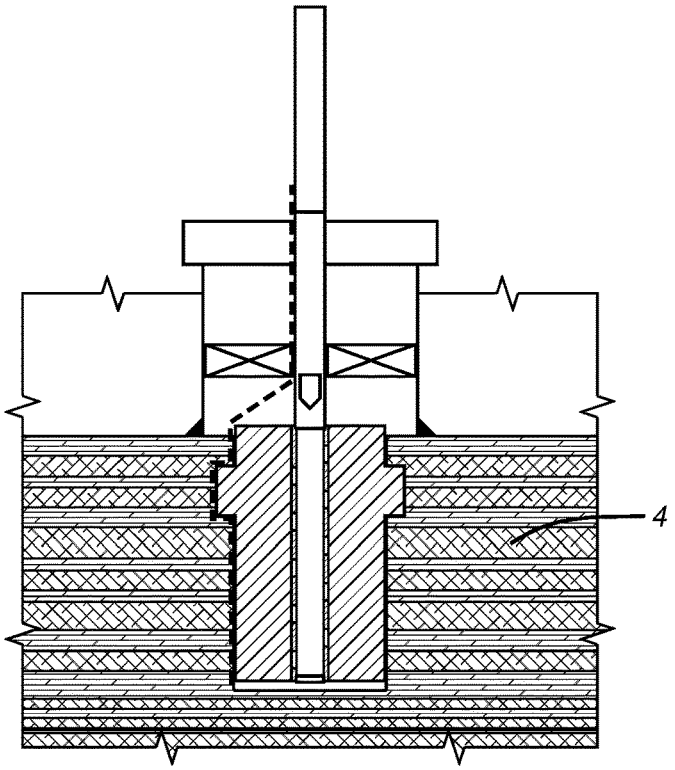
FIG. 3 is the view of FIG. 2 showing the start of methane production.
Figure 4:
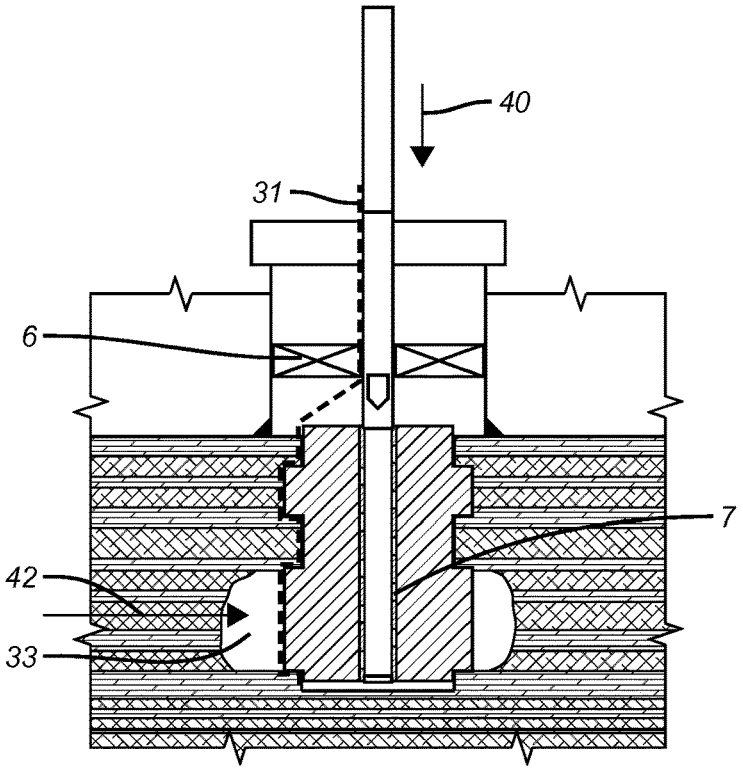
FIG. 4 shows a washout forming after methane production starts.

In FIG. 1 the memory polymer foam 3 is in its run in dimension where it has not yet been warmed above its transition temperature. In FIG. 2 the transition temperature has been reached and the polymer foam 3 has expanded. In FIG. 3 expansion to fill the borehole is complete. Finally, FIG. 4 illustrates the onset of methane production that ensues when the pressure in the methane hydrate reservoir 4 is allowed to be reduced. With the removal of methane a large void volume 10 can be created. This has the beneficial effect of reduction of fluid velocities for the methane. The enlarging of the borehole as well as the flow balancing devices 7 also helps to control high velocity gas erosion to keep the bottom hole assembly serviceable for a longer time before a workover is needed.

Alternatives can be alloy memory foam or screens of various designs that do not change dimension with thermal stimulus. The flow balancing feature can be a porous annular shape or insert plugs in the base pipe or screen materials that vary in mesh size at different opening locations.

Figure 5:
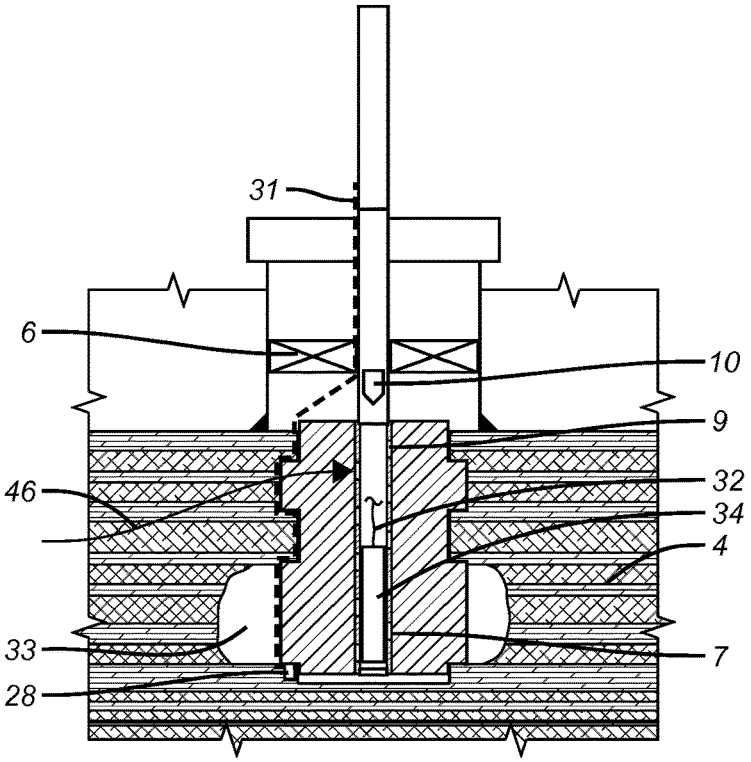
FIG. 5 is the view of FIG. 4 with blocking some of the base pipe openings aligned with the washout.

In another aspect of the invention as shown in FIGS. 1-6 a production pipe 1 has at least one fiber optic cable 31 attached to it. The base pipe has perforations 9 covered by a flow balancing device 7 and memory polymer foam 3 as described above. The borehole extends into a methane hydrate reservoir 4. A pressure and/or temperature and/or strain sensor and transmitter 28 can communicate through cable 31 to convey real time pressure/temperature/strain data to the surface during production. A submersible pump 10 can be used to depressurize the methane hydrate reservoir 4 in the process of producing methane. As shown in FIG. 4 after exposure to well fluids or fluids or heat added near the memory polymer foam 3 the fiber optic cable 31 is pushed against the borehole wall to get baseline stress readings to the surface in real time. The memory polymer foam 3 essentially grows to fill the borehole in methane hydrate reservoir 4. Arrow 40 illustrates the delivery of fluid into the formation 5 as one way to get the memory polymer foam 3 to expand to fill the borehole. In FIG. 4 arrows 42 show the onset of production and the borehole enlarging as a result of such production. The memory polymer foam 3 has some capacity to fill in as the borehole enlarges but there is a limit to such expansion capability on the part of the memory polymer foam 3. Eventually, as production continues a washout 33 opens up and the baseline readings of stress on the fiber optic cable 31 changes in a manner as to give real time data at the surface that parts of the borehole have collapsed and the location of such a collapse. FIG. 5 shows the use of an inner string 32 with a seal assembly 34 delivered to close off some of the base pipe perforations 9 so that production is relocated to arrow 46 that are offset axially from the washout 33. Other options for dealing with the information as to the occurrence of a washout and its location from changing stress on the fiber optic cable 31 is to vary the production rate or to insert a filtering device within the production pipe so that if there is erosion of the flow balancing device 7 it will be backed up by another inserted screen. Note that there is no need to have the memory polymer foam 3 to further expand to fill the washout 33 although forming the memory polymer foam 3 to make that happen is another alternative. Rather the reduction of stress and its location on the fiber optic 31 gives real time notice to take alternative measures such as described above.

Figure 6:
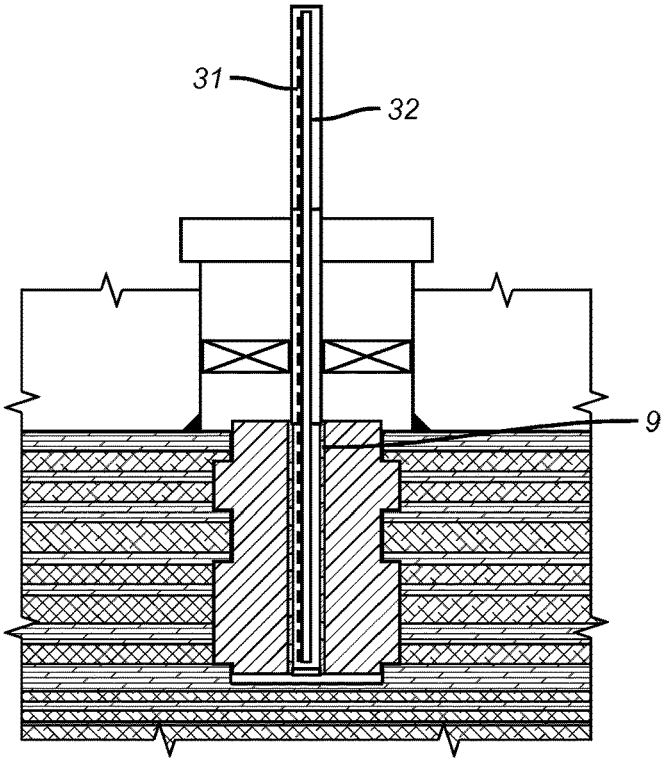
FIG. 6 shows running the fiber optic to the subterranean location on an inner string

In yet another embodiment shown in FIG. 6, the fiber optic cable 31 can be deployed on an inner string 32 inside the base pipe perforations 9. Fiber optic pressure and distributed temperature can be used to infer flow profiles and possible washouts across the interval.

The above description is illustrative of the preferred embodiment and many modifications may be made by those skilled in the art without departing from the invention whose scope is to be determined from the literal and equivalent scope of the claims below:

The invention claimed is:

1. A completion method for methane production from a subterranean location, comprising:

running in a bottom hole assembly to an isolated producing zone, said bottom hole assembly conducting produced fluid away from said subterranean location;

providing a real time signal away from said subterranean location that a portion of a borehole adjacent said bottom hole assembly has washed out during said conducting of produced fluid; and relocating production flow into said bottom hole assembly or changing the rate of said production flow to limit further washing out of said borehole while allowing at least part of said washed out portion of the borehole to remain washed out when conducting produced fluid.

2. The method of claim 1, comprising:

producing methane as said produced fluid.

3. The method of claim 1, comprising:

using a fiber optic cable for said real time signal.

4. The method of claim 3, comprising:

including a shape memory porous material as part of said bottom hole assembly; and mounting said cable over said shape memory porous material.

5. The method of claim 4, comprising:

moving said cable to a borehole wall with said shape memory porous material; and obtaining initial reading of stress in said cable from said moving before said conducting produced fluid.

6. The method of claim 5, comprising:

measuring a reduced stress in said cable as a result of said washed out portion of the borehole due to said conducting produced fluid.

7. The method of claim 6, comprising:

blocking openings in said bottom hole assembly adjacent where said washed out portion of the borehole is indicated by said reduced stress in said cable.

8. The method of claim 7, comprising:

inserting an inner string with at least one seal to block said openings.

9. The method of claim 6, comprising:

changing the rate of said conducting said fluid in response to said measuring reduced stress in said cable.

10. The method of claim 6, comprising:

producing methane as said produced fluid.

11. The method of claim 5, comprising:

causing said shape memory porous material to conform to a borehole shape before conducting said fluid.

12. The method of claim 11, comprising:

allowing washouts in the borehole to remain unfilled by said shape memory porous material after said conforming to an initial borehole shape.

13. The method of claim 11, comprising:

using borehole fluids to take said shape memory porous material past its critical temperature to change shape.

14. The method of claim 11, comprising:

adding fluids or heat through said bottom hole assembly to take said shape memory porous material past its critical temperature to change shape.

15. The method of claim 11, comprising:

producing methane as said produced fluid.

16. The method of claim 5, comprising:

stressing said cable in compression; and using data from said stressing to determine that said shape memory porous material has filled an annular space in the borehole around said bottom hole assembly before said conducting produced fluid from the subterranean location.

17. The method of claim 3, comprising:

extending said cable inside or outside said bottom hole assembly.

18. The method of claim 1, comprising:

transmitting pressure data adjacent said bottom hole assembly in real time as part of said providing a real time signal.

* * * * *